US007608158B2

(12) United States Patent
Liu

(10) Patent No.: US 7,608,158 B2
(45) Date of Patent: Oct. 27, 2009

(54) METHOD OF MAINTAINING PARTICLE SIZE

(75) Inventor: J. Ping Liu, Arlington, TX (US)

(73) Assignee: Board of Regents, the University of Texas System, Austin, TX (US)

( * ) Notice: Subject to any disclaimer, the term of this patent is extended or adjusted under 35 U.S.C. 154(b) by 366 days.

(21) Appl. No.: 11/374,633

(22) Filed: Mar. 13, 2006

(65) Prior Publication Data

US 2006/0246370 A1 Nov. 2, 2006

(51) Int. Cl.
*B22F 1/00* (2006.01)

(52) U.S. Cl. ..... 148/513; 148/105; 148/121

(58) Field of Classification Search ..... 75/252, 75/253, 255; 420/82; 423/151, 152; 977/773
See application file for complete search history.

(56) References Cited

OTHER PUBLICATIONS

K. Elkins, D. Li, et al, Monodisperse face-centered tetragonal FePt nanoparticles with giant coercivity, J. Phys. D: Appl. Phys. 2005, vol. 38, p. 2306-2309.*

K.E. Elkins et al, Ultrafine FePt Nanoparticles Prepared by the Chemical Reduction Method, Nano Letters, 2003, vol. 3, No. 12, p. 1647-1649.*

Y. Ding et al, Sintering prevention and phase transformation of FePt nanoparticles, Journal of Magnetism and Magnetic Materials, 2004, vol. 284, 9. 336-341.*

T. Tsuzuki and P.G. McCormick, Mechanochemical synthesis of nanoparticles, Journal of Materials Science, 2004, vol. 39, p. 5143-5146.*

Maeda, T., et. al., Reduction of ordering temperature of an FePt-ordered alloy by addition of Cu, Applied Physics Letters, American Institute of Physics, 2002, 2147-2149, V. 80, No. 12.

Carpenter, E.E., et. al., Magnetism of nanophase metal and metal alloy particles formed in ordered phases, Journal of Applied Physics, American Institute of Physics, 1999, 5184-5186, V. 85, No. 8.

Ulmeanu, M., et. al., Composition-dependent ratio of orbital-to-spin magnetic moment in structurally disordered Fex Pt1-x nanoparticles, Physical Review B 69, The American Physical Society, 2004, 054417-1 -054417-5.

(Continued)

*Primary Examiner*—George Wyszomierski
*Assistant Examiner*—Mark L Shevin
(74) *Attorney, Agent, or Firm*—J. Peter Paredes; Rosenbaum & Silvert, P.C.

(57) ABSTRACT

The present invention includes particle compositions and methods of fabrication that prevent agglomeration, thereby maintaining particle size and/or shape. Particles of the present invention were prepared after embedding chemically disordered metal-containing particles in at least one salt to form a dispersion. The dispersion of particles in salt was treated to temperatures of at least about 500 degrees Centigrade for several hours. Particles were easily recovered from the dispersion and did not agglomerate. The particles were also absent contaminating salts after performing simple washing and/or rinsing steps. Structural, compositional and/or magnetic characterizations of the metal-containing particles confirmed that they had not agglomerated. When particles with an fcc structure formed a dispersion with at least one salt, the method yielded the formation of particles having an fct structure with high magnetic anisotropy and without a substantial change in size and/or shape. When desired, however, particles shape and/or size may be changed.

21 Claims, 4 Drawing Sheets

OTHER PUBLICATIONS

Yu, A.C.C., et. al., Fabrication of monodispersive FePt nanoparticle films stabilized on rigid substrates, Applied Physics Letters, American Institute of Physics, 2003, 4352-4354, V. 82, No. 24.
Momose, S., et. al., Magnetic properties of magnetically isolated L10-FePt nanoparticles, Applied Physics Letters, American Institute of Physics, 2004, 1748-1750, V. 85, No. 10.
Sato, K., et. al., Preparation and properties of ferromagnetic FePt dispersion, Science Direct, Journal of Magnetism and Magnetic Materials, 2004, 1-4.
Jeyadevan, B., et. al., Direct Synthesis of fct-FePt Nanoparticles by Chemical Route, Japanese Journal of Applied Physics, the Japan Society of Applied Physics, 2003, L350-L352, V. 42, Part 2, No. 4A.
Jeyadevan, B., et. al., Towards direct synthesis of fct-FePt nanoparticles by chemical route, Journal of Applied Physics, American Institute of Physics, 2003, 7574-7576, V. 93, No. 10.
Held, G.A., et. al., Competing interactions in dispersions of superparamagnetic nanoparticles, Physical Review B, The American Physical Society, 2001, 012408-1-012408-4, V. 64.
Kang, S., et. al., Easy axis alignment of chemically partially ordered FePt nanoparticles, Applied Physics Letters 86, American Institute of Physics, 2005, 062503-1-062503-3.
Thomson, T., et.al., FePt magnetic nanoparticles: a Sans study of agglomeration effects, Scientific Highlights Materials Science, 50-51.
Ding, Y., et. al., Sintering prevention and phase transformation of FePt nanoparticles, Science Direct, Journal of Magnetism and Magnetic Materials 284, 2004, 336-341.
Kang, S., et. al., Reduction of the fcc to L10 Ordering Temperature for Self-Assembled FePt Nanoparticles Containing Ag, Nano Letters, American Chemical Society, 2002, 1033-1036, V. 2, No. 10.

* cited by examiner

METHOD OF MAINTAINING PARTICLE SIZE

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. DAAD19-03-1-0038 awarded by the Department of Defense.

BACKGROUND OF THE INVENTION

The present invention relates generally to the field of particle fabrication and in particular to particle compositions and methods of making such compositions that prevent agglomeration, thereby maintaining substantially the same particle size and/or shape.

Maintaining particle size and/or shape, particularly when fabricating metallic-containing particle compositions has proven particularly difficult. This is because metallic-containing particles are typically treated and/or formed at high temperatures (e.g, for phase transition, magnetic hardening, annealing) which typically lead to agglomeration and/or sintering of such particles. For magnetic particles, preventing agglomeration and/or sintering is also important for direct application of particles with high magnetocrystalline anisotropy.

While techniques, such as doping to reduce the transition temperature and coating with high melting point materials, have been used to try to overcome agglomeration and/or sintering, as well as to improve magnetic performance of particles, these methods have resulted in only partial success, are more expensive and/or provide low yields. In addition, current techniques are often deleterious to the magnetic properties of the particles.

As such, there remains a need to prevent agglomeration and/or avoid sintering of metal-containing particles, such that the yield includes disperse particles of substantially the same size and/or shape as the starting particle. When providing for magnetic particles with high magnetic anisotropy, there remains a need to fabricate particles that are disperse and of substantially the same size in order for further use as advanced materials.

SUMMARY OF THE INVENTION

The present invention solves many problems associated with the preparation of metal-containing particle compositions. In particular, the present invention prevents agglomeration and/or avoids sintering of particles such that particles of substantially the same size and/or shape as the starting particle are provided.

Generally, and in one form, the present invention provides for a method of maintaining particle size by providing two or more particles, mixing the two or more particles with a salt to form a dispersion, treating the dispersion with heat at a temperature of at least about 500 degrees Centigrade and isolating the two or more particles from the dispersion, wherein the isolated two or more particles have not agglomerated.

In another form the present invention is a method of providing two or more particles, mixing the two or more particles with a salt to form a dispersion, treating the dispersion with heat at a temperature of at least about 500 degrees Centigrade; and isolating the two or more particles, wherein the isolated two or more particles exhibit high magnetic anisotropy without a substantial change in size. The methods described herein may be performed economically, easily, rapidly, and safely, with few waste products.

The present invention also provides for compositions prepared by methods of the present invention. Prepared compositions are metal-containing particles that do not agglomerate, are of substantially the same size, and, when appropriate, exhibit high magnetic anisotropy. In some embodiments, compositions are converted to a different shape and/or structure, especially one that improves magnetocrystalline anisotropy.

The present invention is particularly suited for fabricating particles required for advanced technologies, especially materials and devices in the electronics and medical industries, such as sensors, recording instruments (e.g., ultra high density storage media), energy-producing materials (e.g., hard magnetic phase component in high energy magnets), and biomedical tools (e.g., magnetic resonance imaging enhancement agents, anticancer therapies, biological and chemical sensors, drug carriers), as examples.

Those skilled in the art will further appreciate the above-noted features and advantages of the invention together with other important aspects thereof upon reading the detailed description that follows in conjunction with the drawings.

BRIEF DESCRIPTION OF SEVERAL VIEWS OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION

Figure 1:
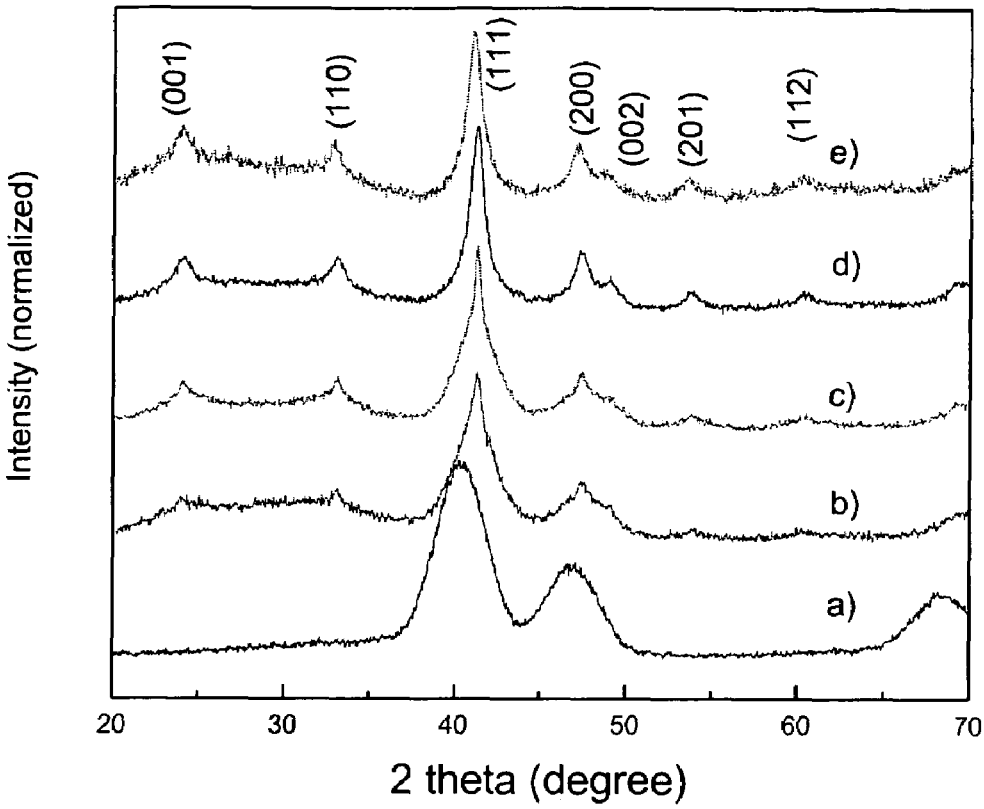
FIG. 1 depicts representative X-ray diffraction (XRD) analyses of particles with face centered cubic (fcc) structure and face centered tetragonal (fct) structure in accordance with one aspect of the present invention.

Although making and using various embodiments of the present invention are discussed in detail below, it should be appreciated that the present invention provides many inventive concepts that may be embodied in a wide variety of contexts. The specific aspects and embodiments discussed herein are merely illustrative of ways to make and use the invention, and do not limit the scope of the invention.

In the description which follows like parts may be marked throughout the specification and drawing with the same reference numerals, respectively. The drawing figures are not necessarily to scale and certain features may be shown exaggerated in scale or in somewhat generalized or schematic form in the interest of clarity and conciseness.

As used herein, agglomerate also refers to similar conditions that produce a cluster, aggregate, collection or mass, such as sintering, coalescence, sticking, clumping and fusing, as examples.

Particles of the present invention may be visible to the naked eye or smaller, such as those with a diameter on the micrometer and nanoscale level. Particles may include circular particles, dots, belts, rods and wires as examples. The particles are metal-containing particles that include a single metal or metal combination (intermetallic), such as iron-platinum (FePt), iron-cobalt, cobalt-platinum, samarium-cobalt, and neodymium-iron-boron, as examples. The particles may also include a ceramic material. In particular, particles are those that do not interact with salts, as further described below, especially at the treatment temperatures useful with the present invention.

Salts described herein may include any salt known to one of ordinary skill in the art, such as chloride (Cl), carbonate ($CO_3$), and sulfur ($SO_4$) salts of sodium (Na), potassium (K), and calcium (Ca), as examples. Salts may be pulverized, powdered, and/or milled (or other such similar variant) to produce more uniformity. One example of milling is ball milling in one or more known organic solvents (e.g., heptane) for a length of time that may be 24 hours to over 200 hours. Salts were used in weight ratios with the particle to form a dispersion. As provided herein, dispersions included one or more salts with two or more particles. Weight ratios were varied from 1:1 to 100:1 (salt:particle).

With the present invention, particles in one phase, structure or shape may be transferred/converted to a difference phase, structure or shape. For example, when preparing magnetic particles, having a face centered tetragonal (fct) space group is important because of the very high magnetic anisotropy of the fct structure. Unfortunately, current synthetic methods for the production of advanced magnetic materials and devices are only capable of producing particles with limited magnetic anisotropy. For example, isotropic FePt fct particles produced to date exhibit only limited anisotropy. Typical methods of producing fct FePt particles requires that fcc particles be heated to temperatures above 500 degrees Centigrade in order to promote phase transfer from the fcc structure to the fct structure. Unfortunately, these methods also create sintering and agglomeration of the fct FePt particles with limited magnetocrystalline anisotropy.

The present invention overcomes these and other limitations by providing particles of a substantially similar size, and when appropriate, with very high magnetocrystalline anisotropy. The present invention relies on methods of forming a dispersion, comprising at least one salt and at least two or more metal-containing particles, prior to treating with heat. Following heat treatment, particles may be recovered rapidly and easily, providing disperse particles of substantially the same size, thereby avoiding agglomeration and/or sintering. As such, the present invention prevents agglomeration and produces disperse particles of substantially the same size and/or shape. When preparing magnetic particles, the present invention provides metal-containing particles that may be isolated as disperse, non-agglomerated particles of substantially the same size and/or shape and with high magnetic anisotropy.

The present invention uses standard airless techniques to prevent oxidation of the metal-containing particles. Typically, an argon environment was used; however, other airless environments known to those of skill in the art may be used (e.g., neutral or reducing and absent oxygen). Reagents used with the present invention were typically from commercial sources and typically used without further purification.

At least one salt was introduced with particles and allowed to form a dispersion. The weight ratio between the salt and the particles was varied, as appropriate. The dispersion was then dried, typically using a ceramic boat or evaporator (e.g., rotavaporator), followed by heat treatment and/or annealing. The temperature used for heat treatment ranged from at least about 500 degrees Centigrade to at least about 700 degrees Centigrade. Heat treatment times were at least about one hour to at least about five hours under reducing or neutral atmospheres (e.g., argon or argon/7% hydrogen). After heat treatment and/or annealing, the dispersion was removed from the heat and cooled to ambient/room temperature in an airless (absent oxygen) environment, such as one comprising argon or a forming gas.

Once cooled, particles were isolated. Isolation (recovery) typically included washing with a washing solution, typically water (e.g., deionized water), to remove the salt. Recovery of particles rely on steps known to one of ordinary skill in the art. One example was to wash in water followed by centrifuging at about 6000 rpm for about 15 minutes. The centrifugation step may be optionally repeated, as needed, to ensure removal of the salt. The example provided herein is only one example of isolating particles. Other recovery steps may be substituted or added as known to one of ordinary skill in the art (e.g., filtering, column purifying, evaporating, etc.). To remove any excess washing solution, particles may be optionally rinsed in a rinsing solution, such as acetone. This step is similar to dehydration. Dehydration and/or removal of the washing and rinsing solutions may rely on other methods known to one of ordinary skill in the art. One example was adding acetone, mixing with an ultrasound, and collecting the particles after centrifugation (e.g., about 6000 rpm for about 15 minutes) by removing (e.g., decanting) the acetone.

With the present invention, salts that exhibited high stability at the heating temperatures (e.g, melting points higher than 500 degrees Centigrade) and high solubility in water were typically more efficient. Examples of salts that were used included: sodium chloride, potassium bicarbonate, and sodium sulfate.

Particle compositions of the present invention were observed by transmission electron microscopy (TEM) images and XRD. XRD analysis was used to characterize and confirm the formation of a phase transfer (when appropriate) and to determine, qualitatively, the scope of salt contamination within the preparation. Morphology of the particles were observed using TEM. The TEM was a JEOL 1200 EX electron microscope at an accelerating voltage of 120 kV. Powder X ray diffraction spectra were recorded on a Philips MPD diffractometer with a copper K$\alpha$ X-ray source ($\lambda$=1.5405 A).

Magnetization values of treated particles were recorded to observe for any potential deterioration, for example, from contamination. Magnetic hysteresis measurements were performed using a SQUID magnetometer recording at 7 T at room temperature. This magnetization value was considered suitable as it represented a magnetization close to saturation. Prior to SQUID analyses, particles were prepared by methods known to one of ordinary skill in the art (e.g., curing in epoxy, embedding in frozen alcohol or water) with and without magnetic field alignment.

For the examples provided below, the salt used when forming the dispersion was NaCl. Initial particles were as-synthesized FePt particles having an fcc structure. Washing and rising steps were performed as described above to isolate or recover FePt particles having an fct structure. Now referring to FIG. 1, several representative XRD patterns from initial and/or isolated particles of about 15.0 nm diameter are shown. To obtain the fct FePt particles, FePt particles of about 15.0 nm diameter having an fcc structure were dispersed using conditions as described above, in a 40:1 salt to particle ratio, a 100:1 salt to particle ratio or a 400:1 salt to particle ratio.

For FIG. 1, the bottom pattern (a) is an XRD analysis of as-synthesized FePt particles having an fcc structure before heat treatment in forming gas. The second pattern from the bottom (b) is an XRD analysis of isolated fct FePt particles after annealing at 600 degrees Centigrade for two hours after dispersion in a salt:particle ratio of 40:1. The third pattern from the bottom (c) is an XRD analysis of isolated fct FePt particles after annealing at 700 degrees Centigrade for two hours after dispersion in a salt:particle ratio of 40:1. The fourth pattern from the bottom (d) is an XRD analysis of isolated fct FePt particles after annealing at 700 degrees Centigrade for four hours after dispersion in a salt:particle ratio of 100:1. The top pattern (e) is an XRD analysis of isolated fct FePt particles after annealing at 700 degrees Centigrade for eight hours after dispersion in a salt:particle ratio of 400:1.

Well-defined (100) and (110) fct peaks for FePt were observed with all heat treatment conditions and were improved when the treatment was 700 degrees Centigrade for at least 2 hours. The lack of salt-associated peaks, as observed in the second, third, fourth and top patterns, indicate that washing and rinsing steps as described above were sufficient to remove contaminating salt. The removal of contaminating salt was confirmed by inductively coupled plasma spectroscopy analyses (data not shown).

Figure 2:
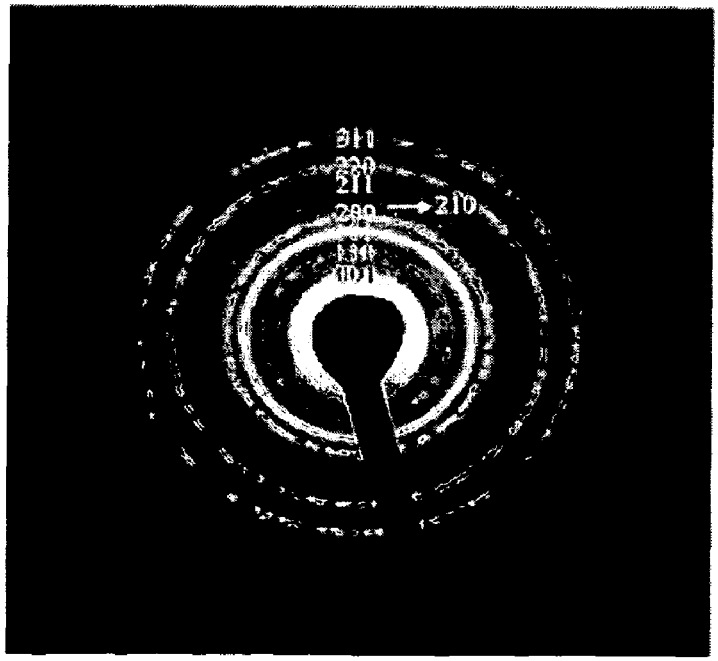
FIG. 2 depicts representative analyses of isolated particles having an fct structure using selective area electron diffraction (SAED) analysis in accordance with another aspect of the present invention.

The phase formation of isolated fct FePt particles using heat treatment conditions of 700 degrees Centigrade for at least about 2 hours in forming gas was also confirmed using SAED as shown in the representative image of FIG. 2.

Figure 3:
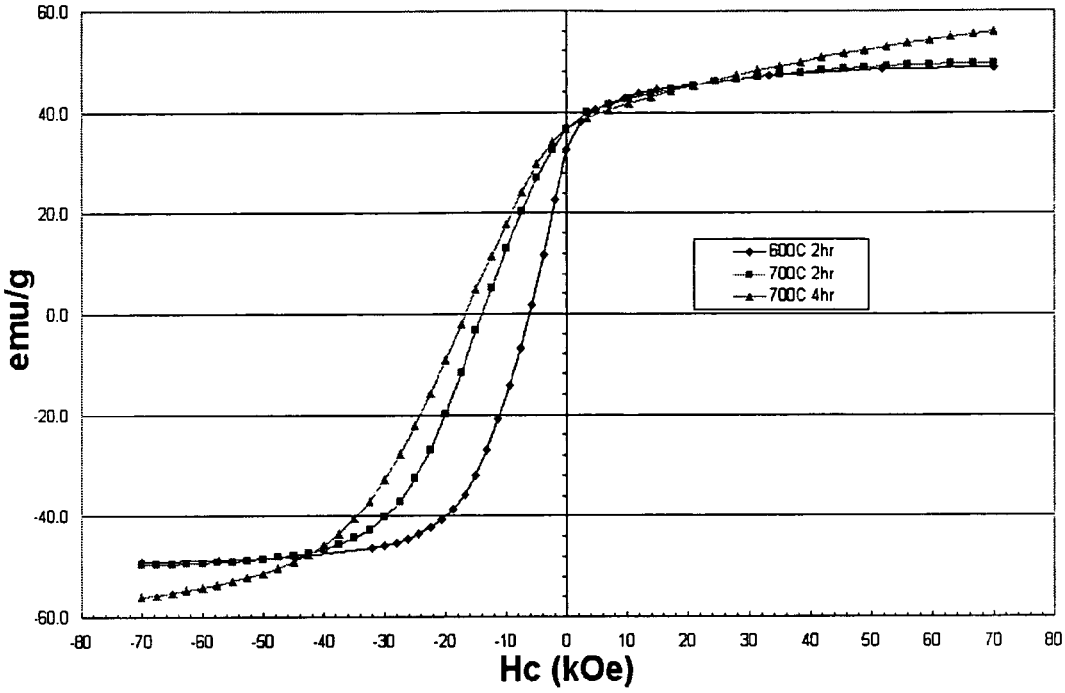
FIG. 3 depicts representative analyses of isolated particles having an fct structure using a Superconducting Quantum Interference Device (SQUID) in accordance with another aspect of the present invention.

FIG. 3 shows a representative SQUID analyses of isolated fct FePt particles of about 15.0 nanometers after dispersion in a salt:particle ratio of 40:1. The various treatment conditions described in FIG. 1 were used. In FIG. 3, the diamond curve shows particles were treated at about 600 degrees Centigrade for about two hours, the square curve shows particles treated at about 700 degrees Centigrade for about two hours, and the triangles curve shows particles treated at about 700 degrees Centigrade for about four hours. For each treatment condition, the rise in the curve depicts the development of the fct phase.

Figure 4:
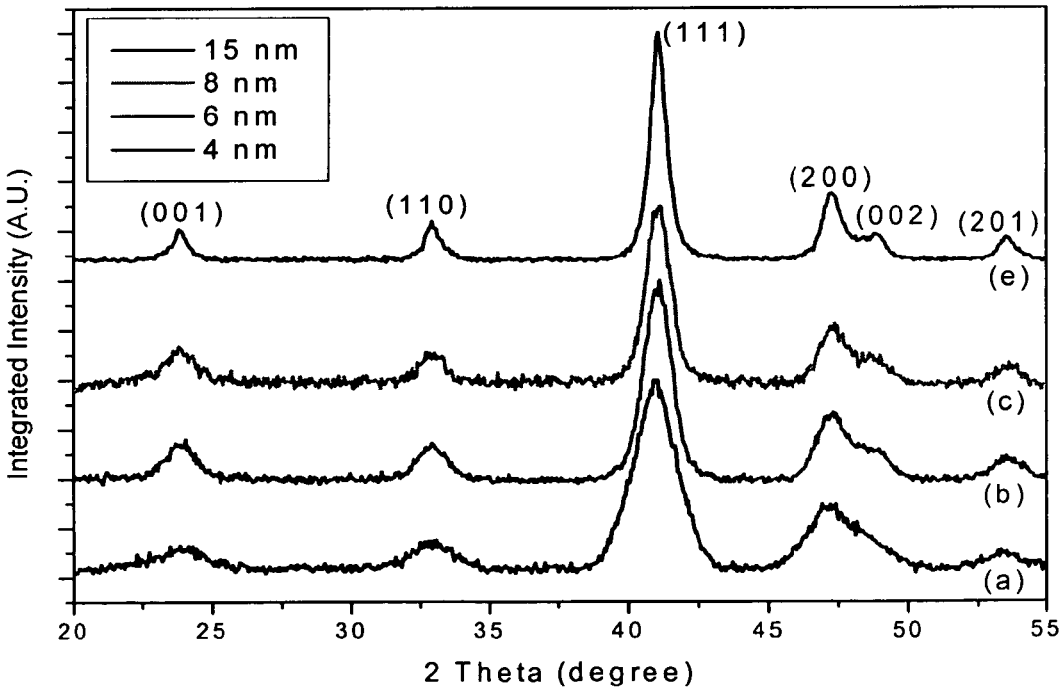
FIG. 4 depicts representative XRD analyses of isolated particles having an fct structure in accordance with another aspect of the present invention.

Now referring to FIG. 4, the representative figure illustrates several XRD analyses of isolated fct FePt particles of varying diameters, including 4.0 nanometers (a or bottom pattern), 6.0 nanometers (b or second pattern from bottom), 8.0 nanometers (c or third pattern from bottom) and 15.0 nanometers (d or top pattern). Here FePt particles having fcc structure were dispersed using conditions similar to those described above in a salt:particle ratio of 40:1. The heat treatment after dispersion was about 700 degrees Centigrade for about 4 hours in a forming gas. Similar to the analyses of FIG. 1, the analyses of FIG. 4 revealed little or no contaminating salt.

Figure 5:
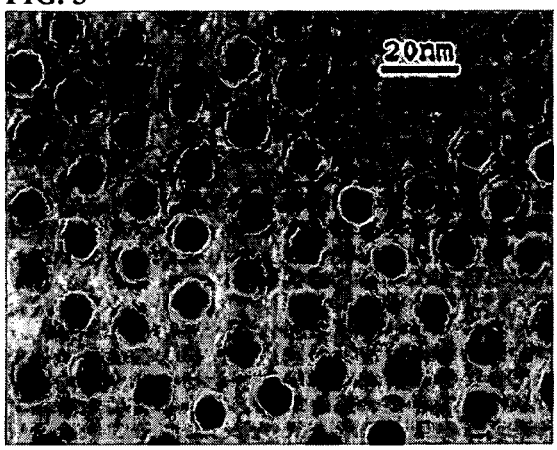
FIG. 5 depicts representative observations of non-treated particles with a face centered cubic (fcc) structure in accordance with one aspect of the present invention.

Observations to illustrate the lack of aggregation and particle growth with the present invention were made before and after heat treatment of dispersed particles using varying salt to particles ratios of 1:1, 2:1, 4:1, 8:1, 20:1, 40:1 and 100:1. FIG. 5 and FIG. 6 are representative TEM images of such observations after particles were isolated and the salt and other solutions were removed. FIG. 5 shows 15.0 nanometer diameter particles comprising FePt having an fcc structure prior to salt dispersion and heat treatment with a scale bar of 20 nanometers.

Figure 6A:
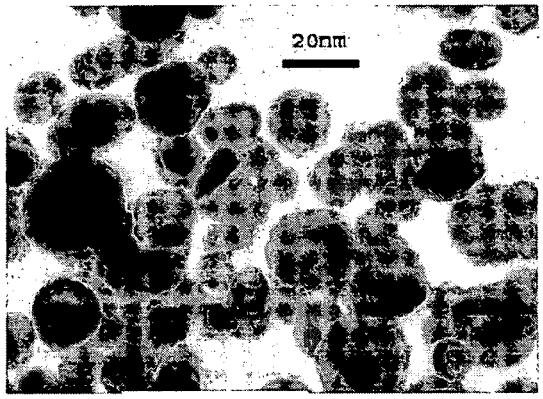
FIG. 6 depicts representative observations of isolated particles having an fct structure under various salt to particle ratios of (A) 8:1, (B) 20:1, and (C) 40:1.
Figure 6B:
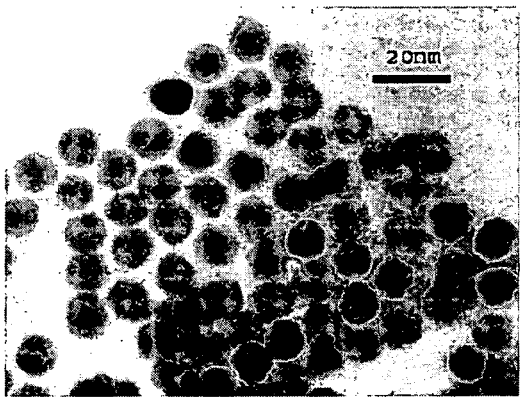
Figure 6C:
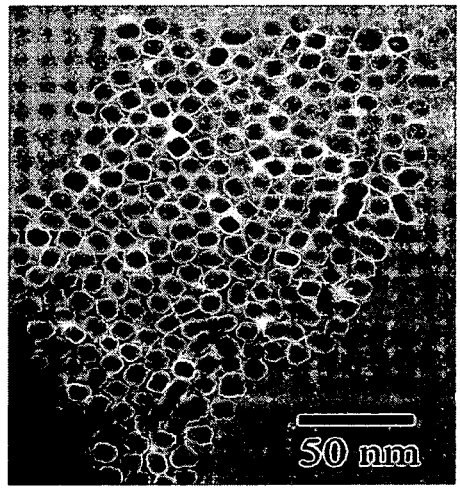

For FIGS. 6A, 6B, and 6C, particles of either 8.0 or 15.0 nanometer diameter were treated at about 700 degrees Centigrade for about 2 hours. FIG. 6A shows isolated particles comprising FePt with an fct structure after dispersion with a salt, in which the salt:particles ratio was 8:1. FIG. 6B shows isolated particles comprising FePt with an fct structure after dispersion with a salt, in which the salt:particles was 20:1. FIG. 6C illustrates isolated particles comprising FePt with an fct structure after dispersion with a salt, in which the salt:particles ratio was 40:1. The scale bar in FIGS. 6A and 6B is 20 nanometers while the scale bar in FIG. 6C is 50 nm. The initial particle size used for FIG. 6C was 8.0 nanometers in diameter. Here, isolated particles were primarily tetragonal. In general, the observations showed that present invention provided isolated particle substantially of substantially the same shape and size as the initial particle. In addition, under these heat treatment conditions, use of higher ratios of salt:particles improved overall particle dispersion and reduced agglomeration. In addition, under these treatment conditions, when lower ratios of salt:particles were used, more particle growth was observed (data not shown).

Figure 7:
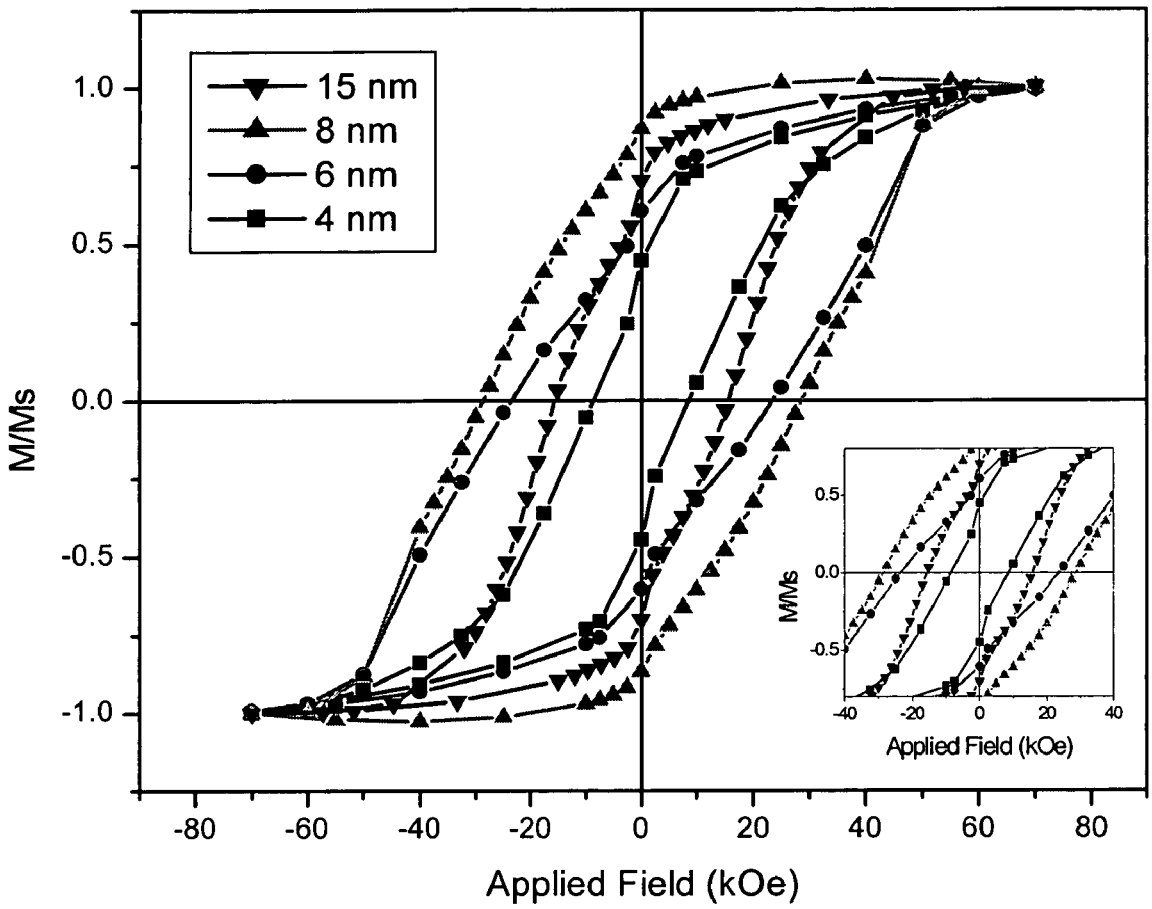
FIG. 7 depicts a representative SQUID analysis of isolated particles with an fct structure in accordance with another aspect of the present invention.

Isolated particles of the present invention exhibited improved properties as shown in FIG. 7. For FIG. 7, isolated fct FePt particles of varying diameter, as described for FIG. 4 (i.e., 4 nanometers, 6 nanometers, 8 nanometers and 15.0 nanometer) were dispersed, as described herein in a salt:particle ratio of 40:1 followed by heat treatment after dispersion at a temperature of about 700 degrees Centigrade for about 4 hours in a forming gas. After recovery, sample particles of each diameter were set in epoxy before being measured by a SQUID magnetometer. The isolated fct FePt particles exhibited very high coercivities up to 3.0 Tesla at room temperature. Moreover, when dispersed and treated particles showed an fct structure, coercivity values of these particles, as measured by SQUID, were typically greater than 2 T at room temperature. A representative diagram of the magnetization hysteresis loops for the fct particles is shown in FIG. 7. The loop depicted by the upside-down triangles is for fct particles of 15 nanometers. The loop depicted by the right-side up triangles is for fct particles of 8 nanometers. The loop depicted by the diamonds is for fct particles of 6 nanometers and the loop depicted by the upside-down squares is for fct particles of 4 nanometers. Isolated particles were also embedded in alcohol or water and analyzed by a SQUID magnetometer (data not shown).

As described herein, the present invention provides for quick and inexpensive methods of forming a dispersion and subsequent treatment of particles that produce well defined metal-containing particles that remain dispersed and do not agglomerate. The recovered particles were obtained after embedding initial chemically disordered particles in a salt matrix to form a dispersion. The dispersion was formed by adding at least one salt to the particles. The dispersion was then treated to temperatures of at least about 500 degrees Centigrade for several hours. Particles recovered from the dispersion did not agglomerate and were of substantially similar shape and/or size as the initial particles. Moreover, recovery of the particles was rapid, easy, and inexpensive. In addition, isolated particles were absent contaminating salts.

Structural, compositional and magnetic characterizations of the isolated particles confirmed their dispersion as well as their substantially similar size and/or shape.

Under appropriate conditions, formation of particles having an fct phase structure with high magnetic anisotropy were isolated after dispersing and treating particles with an fcc structure. The phase transferred particles were of substantially similar size and/or shape as the initial particles. As such, compositions prepared by methods of the present invention are appropriate for use in applications requiring such improved compositions.

Additional objects, advantages and novel features of the invention as set forth in the description, will be apparent to one skilled in the art after reading the foregoing detailed description or may be learned by practice of the invention. The objects and advantages of the invention may be realized and attained by means of the instruments and combinations particularly pointed out here.

What is claimed is:

1. A method of maintaining magnetic nanoparticle size comprising:

providing two or more magnetic nanoparticles in a nanoscale dispersion, wherein each nanoparticle contains at least one metal, an initial nanoparticle size and shape, and does not interact with a pulverized salt at a treatment temperature;

wherein the two or more magnetic nanoparticles are selected from the group consisting of iron-platinum, cobalt-platinum, samarium-cobalt, ceramic material, intermetallic particles, iron-cobalt, and neodymium-iron-boron;

mixing the two or more magnetic nanoparticles with the pulverized salt that includes a melting point higher than 500 degrees Centigrade in the nanoscale dispersion;

treating the nanoscale dispersion with heat at the treatment temperature that is at least about 500 degrees Centigrade; and isolating the two or more nanoparticles from the nanoscale dispersion, wherein the isolated two or more magnetic nanoparticles have not agglomerated and have an annealed size and shape substantially the same as the initial nanoparticle size and shape.

2. The method of claim 1, wherein heat treating occurs under a reducing or neutral atmosphere for a period of time of at least about one hour to at least about five hours.

3. The method of claim 1, further comprising cooling the dispersion to an ambient temperature before isolating.

4. The method of claim 3, wherein cooling is performed in an environment selected from the group consisting of argon and a forming gas.

5. The method of claim 1, wherein isolating includes washing the dispersion with a washing solution comprising water to remove the at least one salt and then centrifuging at about 6000 rpm for 15 minutes.

6. The method of claim 5, further comprising rinsing the dispersion with a rinsing solution including acetone to remove the water.

7. The method of claim 1, wherein the pulverized salt is is selected from the group consisting of sodium chloride, potassium chloride, calcium chloride, sodium bicarbonate, potassium bicarbonate, calcium bicarbonate and combinations thereof.

8. The method of claim 1, wherein the diameter of the two or more magnetic nanoparticles is in the nanometer scale between at least about 4 and 15 nm and the particles are iron-platinum including an fct structure after the treating the dispersion with step.

9. The method of claim 1, wherein the isolated two or more magnetic nanoparticles exhibit high magnetic anisotropy and coercivity values greater than 2T at room temperature.

10. The method of claim 1, wherein the salt to nanoparticle ratio is selected based upon the annealed size of the particle.

11. A method of maintaining magnetic nanoparticle size comprising:

providing two or more magnetic particles, wherein each magnetic nanoparticle is selected from the group consisting of iron-platinum, cobalt-platinum, samarium-cobalt, iron-cobalt, and neodymium-iron-boron, each magnetic nanoparticle does not interact with a pulverized salt at a treatment temperature and includes an initial nanoparticle size and shape;

mixing the two or more magnetic nanoparticles with the pulverized salt at a salt to nanoparticle weight ratio from 8:1 to 400:1 to form a nanoscale dispersion;

treating the nanoscale dispersion with heat at the treatment temperature that is at least about 500 degree Centigrade to obtain an annealed nanoparticle size and shape; and isolating the two or more nanoparticles from the nanoscale dispersion, wherein the isolated two or more magnetic nanoparticles exhibit high magnetic anisotropy without a substantial change in the initial nanoparticle size and shape from the annealed nanoparticle size and shape.

12. The method of claim 11, wherein the pulverized salt is selected from the group consisting of sodium chloride, potassium chloride, calcium chloride, sodium bicarbonate, potassium bicarbonate, calcium bicarbonate and combinations thereof.

13. The method of claim 11, wherein treating occurs under a reducing or neutral atmosphere.

14. The method of claim 11, further comprising cooling the dispersion to an ambient temperature before isolating.

15. The method of claim 14, wherein cooling is performed in an environment selected from the group consisting of argon and a forming gas.

16. The method of claim 11, wherein isolating includes washing the dispersion with a washing solution comprising water to remove the at least one salt.

17. The method of claim 11, further comprising rinsing the dispersion with a rinsing solution to remove the water.

18. The method of claim 11, wherein the diameter of the two or more magnetic nanoparticles is in the nanometer scale.

19. The method of claim 11, wherein the isolated two or more nanoparticles are converted to a different shape or structure and include coercivity values greater than 2T at room temperature.

20. The method of claim 11, wherein the salt to particle ratio is selected based upon the annealed nanoparticle size.

21. A method of maintaining magnetic nanoparticle size comprising:

a. providing two or more FePt nanoparticle, wherein each FePt nanoparticle contains an initial nanoparticle size and shape, does not interact with a pulverized salt at a treatment temperature, and includes an fcc structure;

b. mixing the two or more FePt nanoparticles with the pulverized salt at a pulverized salt to FePt nanoparticle weight ratio from 8:1 to 400:1 and is selected based upon a final annealed size of the FePt nanoparticle, where the pulverized salt includes a melting point higher than 500 degrees Centigrade to form a nanoscale dispersion;

c. heat treating the nanoscale dispersion in a reducing atmosphere and at the treatment temperature that is at least about 700 degrees Centigrade;

d. cooling the nanoscale dispersion to an ambient temperature in a reducing atmosphere; and e. isolating the two or more FePt nanoparticles from the nanoscale dispersion by washing the nanoscale dispersion to remove the pulverized salt, wherein the isolated two or more FePt nanoparticles have not agglomerated, have an annealed size and shape substantially the same as the initial nanoparticle size and shape, and have an fct structure.

* * * * *